US012789965B2

(12) United States Patent
Moromi et al.

(10) Patent No.: US 12,789,965 B2
(45) Date of Patent: Nov. 10, 2026

(54) MARINE PROPULSION SYSTEM, CONTROL METHOD THEREFOR, AND MARINE VESSEL

(71) Applicant: YAMAHA HATSUDOKI KABUSHIKI KAISHA, Iwata (JP)

(72) Inventors: Shuichi Moromi, Shizuoka (JP); Akihiro Tagata, Shizuoka (JP); Yuta Kubota, Shizuoka (JP); Katsutoshi Naito, Shizuoka (JP); Koshiro Inaba, Shizuoka (JP); Teppei Morishita, Shizuoka (JP); Kazumichi Yoshida, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 256 days.

(21) Appl. No.: 18/777,665

(22) Filed: Jul. 19, 2024

(65) Prior Publication Data

US 2025/0050990 A1 Feb. 13, 2025

(30) Foreign Application Priority Data

Aug. 10, 2023 (JP) ..... 2023-130807

(51) Int. Cl.
*B63H 21/21* (2006.01)
*B63H 20/08* (2006.01)
(Continued)

(52) U.S. Cl.
CPC ..... *B63H 21/21* (2013.01); *B63H 20/08* (2013.01); *B63H 25/04* (2013.01); *B63H 25/42* (2013.01);
(Continued)

(58) Field of Classification Search
CPC ..... B63H 21/00; B63H 21/21; B63H 25/00; B63H 25/04; B63H 25/42; B63H 20/00;
(Continued)

(56) References Cited

U.S. PATENT DOCUMENTS 3,965,844 A 6/1976 Brock et al.
3,980,039 A 9/1976 Henning
(Continued)

OTHER PUBLICATIONS

Official Communication issued in corresponding European Patent Application No. 24192324.2, mailed on Feb. 6, 2025, 10 pages.

*Primary Examiner* — Lars A Olson
(74) *Attorney, Agent, or Firm* — Keating & Bennett, LLP

(57) ABSTRACT

A marine propulsion system includes a propulsion device movable between a use position and a storage position and changeable in a direction by a steering operation, a receiver to receive a use start instruction designating a maneuvering mode of the propulsion device, a controller to move the propulsion device to the use position in response to reception of the use start instruction, an obtainer to obtain a latest maneuvering instruction content in response to reception of the use start instruction, and a determiner to determine the direction of the propulsion device based on the maneuvering mode designated in the use start instruction and the latest maneuvering instruction content. The controller starts a process of steering the propulsion device to the determined direction during movement of the propulsion device to the use position and before completion of the movement of the propulsion device to the use position.

14 Claims, 8 Drawing Sheets

(51) Int. Cl.
*B63H 25/04* (2006.01)
*B63H 25/42* (2006.01)
*B63H 25/02* (2006.01)

(52) U.S. Cl.
CPC .. *B63H 2021/216* (2013.01); *B63H 2025/028* (2013.01)

(58) Field of Classification Search
CPC ..... B63H 20/08; B63H 2021/216; B63H 2025/028; G05D 1/00; G05D 1/02
USPC ..... 440/84; 701/21
See application file for complete search history.

(56) References Cited

U.S. PATENT DOCUMENTS

| | | | | |
|---|---|---|---|---|
| 6,280,267 | B1 | 8/2001 | Griffith, Sr. et al. | |
| 6,447,347 | B1 | 9/2002 | Steinhauser | |
| 8,190,316 | B2 | 5/2012 | Kaji | |
| 10,095,232 | B1 * | 10/2018 | Arbuckle ..... | B63H 25/42 |

* cited by examiner

MARINE PROPULSION SYSTEM, CONTROL METHOD THEREFOR, AND MARINE VESSEL

CROSS REFERENCE TO RELATED APPLICATIONS

This application claims the benefit of priority to Japanese Patent Application No. 2023-130807 filed on Aug. 10, 2023. The entire contents of this application are hereby incorporated herein by reference.

BACKGROUND OF THE INVENTION

1. Field of the Invention

The present invention relates to marine propulsion systems, control methods therefor, and marine vessels.

2. Description of the Related Art

There is a known marine propulsion system that can move a trolling motor to a use position and a storage position by an electric motor (see U.S. Pat. Nos. 6,447,347; 3, 965, 844; and 3,980,039).

Generally, when a user maneuvers a marine vessel using a propulsion force of a trolling motor, the propulsive force with a desired magnitude and in a desired direction can be obtained after the trolling motor is lowered to a use position and steered in a direction (steering angle) corresponding to a maneuvering instruction by a steering operation.

However, the steering angle when the trolling motor is lowered to the use position is generally determined uniformly. Therefore, a deviation between a direction of the trolling motor corresponding to the intention of a user or a controller and the actual direction of the trolling motor may be large immediately after the trolling motor is lowered to the use position. The propulsion force with a desired magnitude and in a desired direction cannot be obtained until the trolling motor rotates to a direction corresponding to the maneuvering instruction. Therefore, if the deviation is too large, the start of propulsion by the trolling motor is substantially delayed.

SUMMARY OF THE INVENTION

Example embodiments of the present invention provide marine propulsion systems that are each able to reduce or prevent a delay in starting propulsion by a propulsion device.

According to a first example embodiment of the present invention, a marine propulsion system includes a propulsion device movable between a use position and a storage position and changeable in a direction by a steering operation, a receiver to receive a use start instruction designating a maneuvering mode to be executed among a plurality of maneuvering modes of the propulsion device, a controller configured or programmed to move the propulsion device to the use position in response to reception of the use start instruction, an obtainer to obtain a latest maneuvering instruction content in response to reception of the use start instruction, and a determiner to determine the direction of the propulsion device based on the maneuvering mode designated in the use start instruction and the latest maneuvering instruction content. The controller is configured or programmed to start a process of steering the propulsion device to the determined direction during movement of the propulsion device to the use position and before completion of the movement of the propulsion device to the use position in response to reception of the use start instruction.

According to a second example embodiment of the present invention, a marine propulsion system includes a propulsion device movable between a use position and a storage position and changeable in a direction by a steering operation, a detector to detect an instruction or an operation to move the propulsion device to the use position as a motion start trigger, a controller configured or programmed to move the propulsion device to the use position in response to detection of the motion start trigger, an obtainer to obtain a latest maneuvering instruction content in response to detection of the motion start trigger, and a determiner to determine the direction of the propulsion device based on the latest maneuvering instruction content. The controller is configured or programmed to start a process of steering the propulsion device to the determined direction during movement of the propulsion device to the use position and before completion of the movement of the propulsion device to the use position in response to detection of the motion start trigger.

According to a third example embodiment of the present invention, a marine vessel includes a hull and the marine propulsion system of the first example embodiment.

According to a fourth example embodiment of the present invention, a control method for a marine propulsion system including a propulsion device movable between a use position and a storage position and changeable in a direction by a steering operation includes receiving a use start instruction designating a maneuvering mode to be executed among a plurality of maneuvering modes of the propulsion device, moving the propulsion device to the use position in response to receiving the use start instruction, obtaining a latest maneuvering instruction content in response to receiving the use start instruction, determining the direction of the propulsion device based on the maneuvering mode designated in the use start instruction and the latest maneuvering instruction content, and starting a process of steering the propulsion device to the determined direction during movement of the propulsion device to the use position and before completion of the movement of the propulsion device to the use position in response to receiving the use start instruction.

According to the above examples, a delay in starting propulsion by a propulsion device is reduced or prevented.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Hereinafter, example embodiments of the present invention will be described with reference to the drawings.

Figure 1:
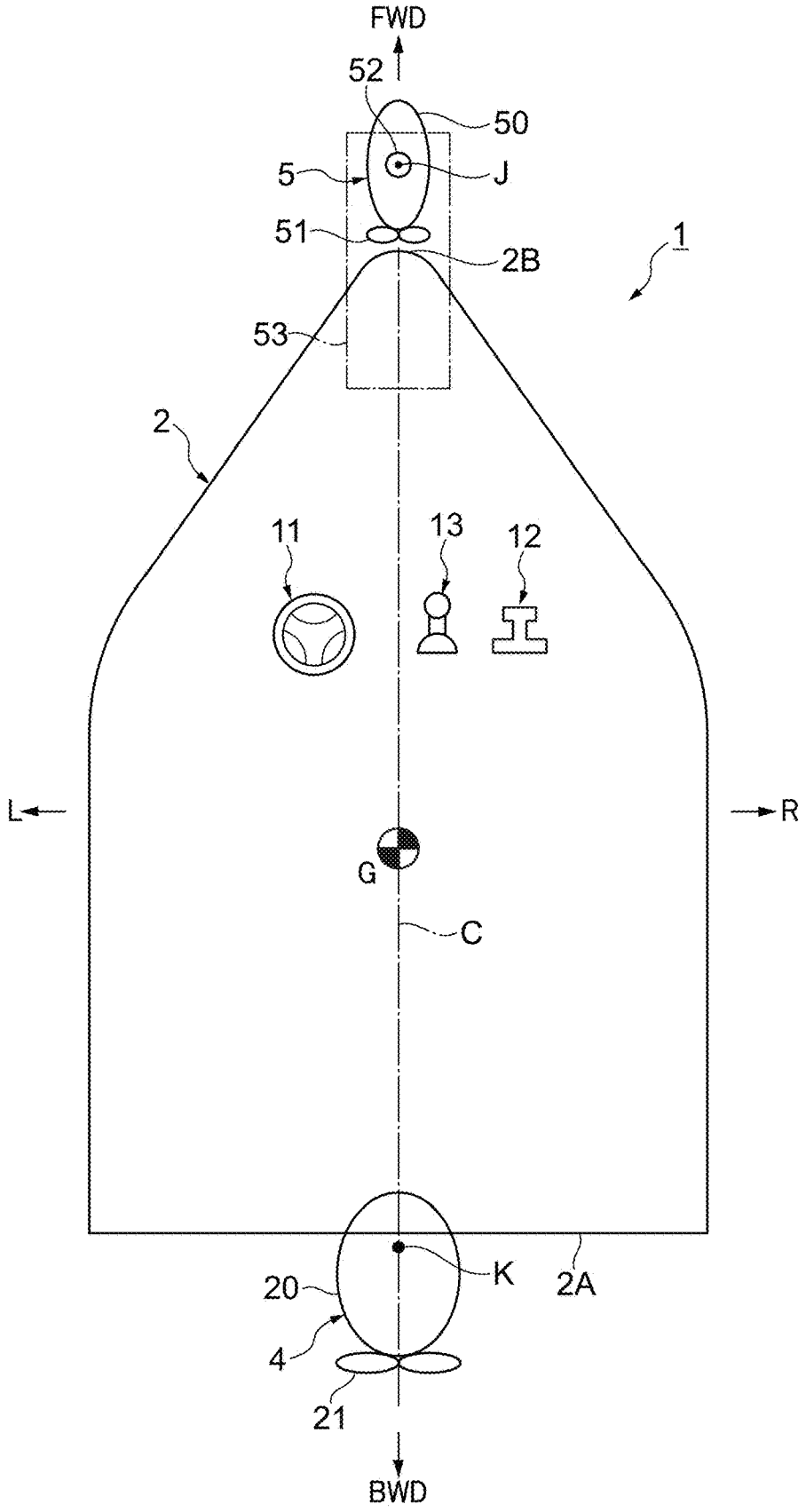
FIG. 1 is a schematic top view showing a marine vessel to which a marine propulsion system is provided.

FIG. 1 is a schematic top view of a marine vessel to which a marine propulsion system according to an example embodiment of the present invention is provided. The marine vessel 1 includes a hull 2.

In the drawings, a forward direction (bow direction) of the marine vessel 1 is indicated by an arrow FWD, and a backward direction (stern direction) is indicated by an arrow BWD. Further, a starboard direction of the marine vessel 1 is indicated by an arrow R, and a port direction thereof is indicated by an arrow L.

A center line C of the hull 2 passes through a center of a stern 2A and a tip of a bow 2B. The center line C passes through a center of gravity G (turning center) of the marine vessel 1. A front-back direction is a direction parallel to the center line C. A front is in a direction upward along the center line C shown in FIG. 1 (a direction toward the bow 2B viewed from the stern 2A). A back is in a direction downward along the center line C shown in FIG. 1. The left-right direction is based on a case where the hull 2 is viewed from the back. An up-down direction is perpendicular to the front-back direction and the left-right direction.

The marine vessel 1 includes a steerable outboard motor 4 (first propulsion device) and a steerable trolling motor 5 (second propulsion device) as propulsion devices that propel the hull 2. The outboard motor 4 is disposed at the stern 2A, and the trolling motor 5 is disposed at the bow 2B. The trolling motor 5 may be disposed at a predetermined position in front of the stern 2A of the hull 2, and the position of the trolling motor 5 is not limited to the bow 2B of the hull 2. The outboard motor 4 and the trolling motor 5 may be a main propulsion device and an auxiliary propulsion device, respectively, in the marine vessel 1. The single outboard motor 4 is provided at a central portion in the lateral direction in the stern 2A.

The marine vessel 1 is provided with a steering (e.g., a steering wheel) 11 operated mainly for steering, a throttle operator 12 operated mainly for output adjustment of the outboard motor 4, and a joystick 13 operated mainly for steering and output adjustment of the outboard motor 4. The layout of these components is not limited to the illustrated one.

Figure 2:
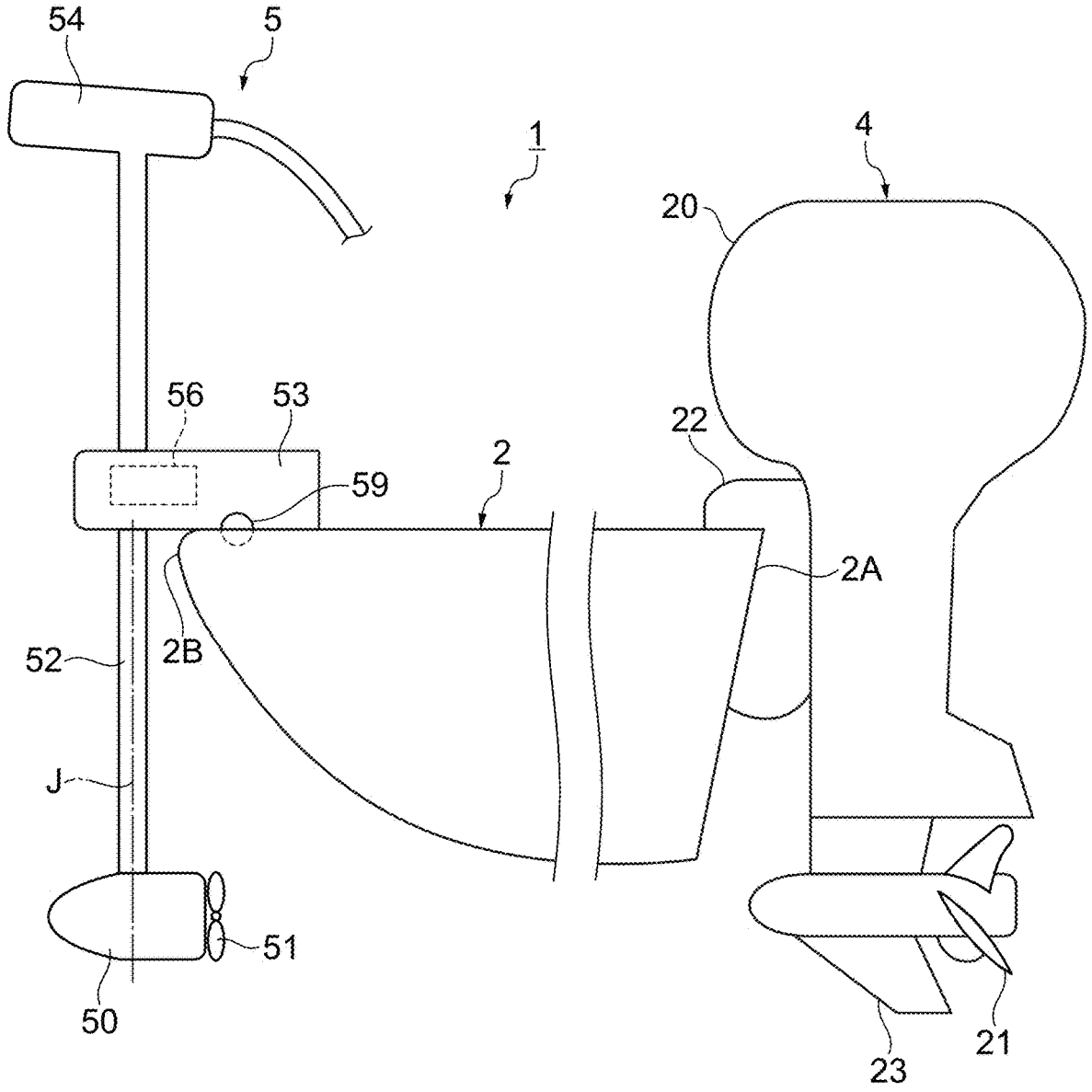
FIG. 2 is a schematic side view showing bow and stern portions of the marine vessel.

FIG. 2 is a schematic side view showing the bow portion and the stern portion of the marine vessel 1.

The outboard motor 4 includes an outboard motor body 20. A propeller 21 and a skeg (rudder) 23 are disposed in a lower portion of the outboard motor body 20. The outboard motor body 20 is mounted to the stern 2A with a mounting mechanism 22. The mounting mechanism 22 includes a clamp bracket detachably fixed to the stern 2A and a swivel bracket coupled to the clamp bracket so as to be rotatable about a tilt shaft. The outboard motor body 20 is mounted to the swivel bracket so as to be rotatable about a steering axis center K (FIG. 1). The steering angle of the outboard motor 4 is changed by rotating the outboard motor body 20 about the turning axis center K.

The trolling motor 5 is an aftermarket device that can be externally attached to the already completed marine vessel 1 at a later time, unlike a bow thruster (not shown). The trolling motor 5 is capable of applying a propulsion force to the hull 2 in any direction around a rotation axis J (FIG. 1), which is the center line of a rotation shaft 52.

The trolling motor 5 is electrically driven. The trolling motor 5 includes an electric motor 50 and a propeller 51 that is rotationally driven by the electric motor 50 to generate a propulsion force. The trolling motor 5 further includes the rotation shaft 52 extending upward from the electric motor 50 through the rotation axis J, and a bracket 53 fixed to the bow 2B and supporting the rotation shaft 52 rotatably around the rotation axis J. The electric motor 50 rotates around the rotation axis J integrally with the rotation shaft 52.

An upper portion of the rotation shaft 52 protrudes upward from the bracket 53. An operation panel 54 including an indicator (not shown) indicating the direction of the propeller 51 in the water is provided at the upper end of the rotation shaft 52. The bracket 53 is provided with an operation unit (not shown), such as a foot pedal, for a user to directly operate the trolling motor 5. In addition, a wireless remote controller (not shown) for the user to operate the trolling motor 5 may be provided. The operation panel 54 is not shown in FIG. 1.

The trolling motor 5 includes, for example, an electric steering unit 56 in the bracket 53 and rotates the rotation shaft 52 and the electric motor 50 around the rotation axis J, and an ECU (not shown) in the operation panel 54 and controls the electric motor 50 and the steering unit 56.

The steering unit 56 includes, for example, a servo motor. The trolling motor 5 is able to change its direction by a steering operation by the steering unit 56. First, the steering unit 56 changes the direction of the propulsion force generated by the rotating propeller 51 by rotating the electric motor 50 about the rotation axis J to change the direction of the electric motor 50 within a range of 360 degrees or more. This changes the steering angle of the trolling motor 5, and the direction of the propulsion force applied to the hull 2 by the trolling motor 5 changes.

The bracket 53 is vertically pivotable with respect to the hull 2 around a pivot shaft 59. The bracket 53 is rotated about the pivot shaft 59 so that the trolling motor 5 can be moved between a use position and a storage position. FIGS. 1 and 2 show a state in which the trolling motor 5 is in the use position. When the trolling motor 5 is in the use position, the electric motor 50 and the propeller 51 are located below a waterline (not shown).

Figure 3:
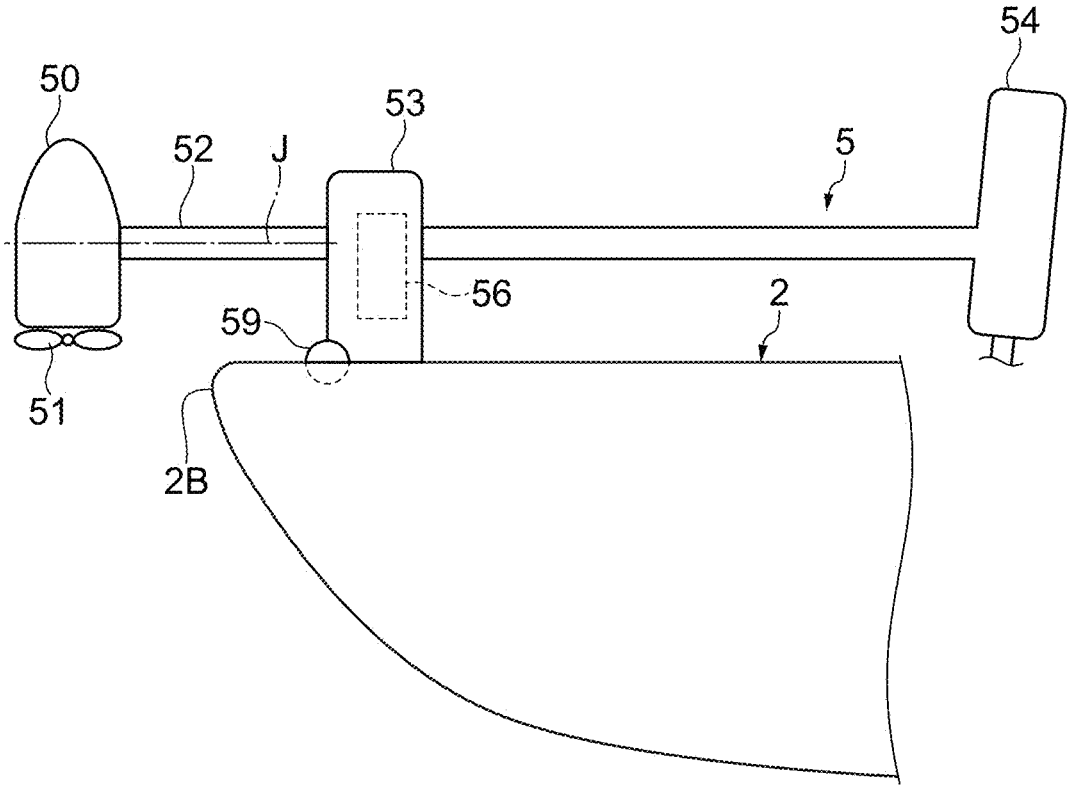
FIG. 3 is a schematic side view showing a front portion of the marine vessel when a trolling motor is in a storage position.

FIG. 3 is a schematic side view showing a front portion of the marine vessel 1 in a state where the trolling motor 5 is in the storage position.

The trolling motor 5 can be manually moved between the use position and the storage position. In addition, the trolling motor 5 can be automatically moved to the use position and the storage position by power, such as electric power or hydraulic power. In the case of automatic movement, the movement is controlled by a controller 70 (FIG. 6) described below.

The rotation shaft 52 is driven by an actuator 61 (described below with respect to FIG. 6) and is slidable in the direction of the rotation axis J with respect to the bracket 53. The bracket 53 can be rotated around the pivot shaft 59 by the actuator 61. In the use position, the electric motor 50 is located at a position farthest from the bracket 53. In order to move the electric motor 50 from the use position to the storage position, the controller 70 controls the actuator 61 to slide the rotation shaft 52 in the direction of the rotation axis J with respect to the bracket 53 to make the electric motor 50 approach the bracket 53. In parallel with this, the controller 70 controls the actuator 61 to rotate the bracket 53 clockwise in FIG. 2 about the pivot shaft 59. When the trolling motor 5 pivots to the storage position shown in FIG. 3, the trolling motor 5 enters into a storage state.

The mechanism to shift the trolling motor 5 between the use position and the storage position is not limited to the illustrated mechanism. The storage position may be any position suitable for a state where the trolling motor 5 is not used, and the electric motor 50 and the propeller 51 may be positioned above the waterline.

In the present example embodiment, the plurality of maneuvering modes are roughly classified into an outboard motor mode in which the trolling motor 5 is not used and cooperation modes in which the trolling motor 5 and the outboard motor 4 are used in combination. The outboard motor mode is a maneuvering mode in which the outboard motor 4 is controlled mainly according to the rotation operation of the steering 11 and the operation of the throttle operator 12.

The cooperation modes include automatic maneuvering modes, a joystick mode, a drive mode (steering wheel maneuvering mode), and a normal cooperation mode. The joystick mode is a maneuvering mode in which the outboard motor 4 and the trolling motor 5 are controlled according to the operation of the joystick 13. The drive mode is a maneuvering mode in which the outboard motor 4 and the trolling motor 5 are controlled based on operations of various switches and paddles (described below) in the steering 11 and a rotation operation of the steering 11.

The automatic maneuvering modes are modes in which the outboard motor 4 and the trolling motor 5 are controlled to automatically hold a route, a heading, or a position of the hull 2, when a target position of the hull 2 or a target heading of the hull 2 is designated. Typical examples of the automatic maneuvering modes include a Stay Point™, a Fish Point™, and a Drift Point™. The normal cooperation mode is a mode in which the user individually operates each of the outboard motor 4 and the trolling motor 5.

Figure 4:
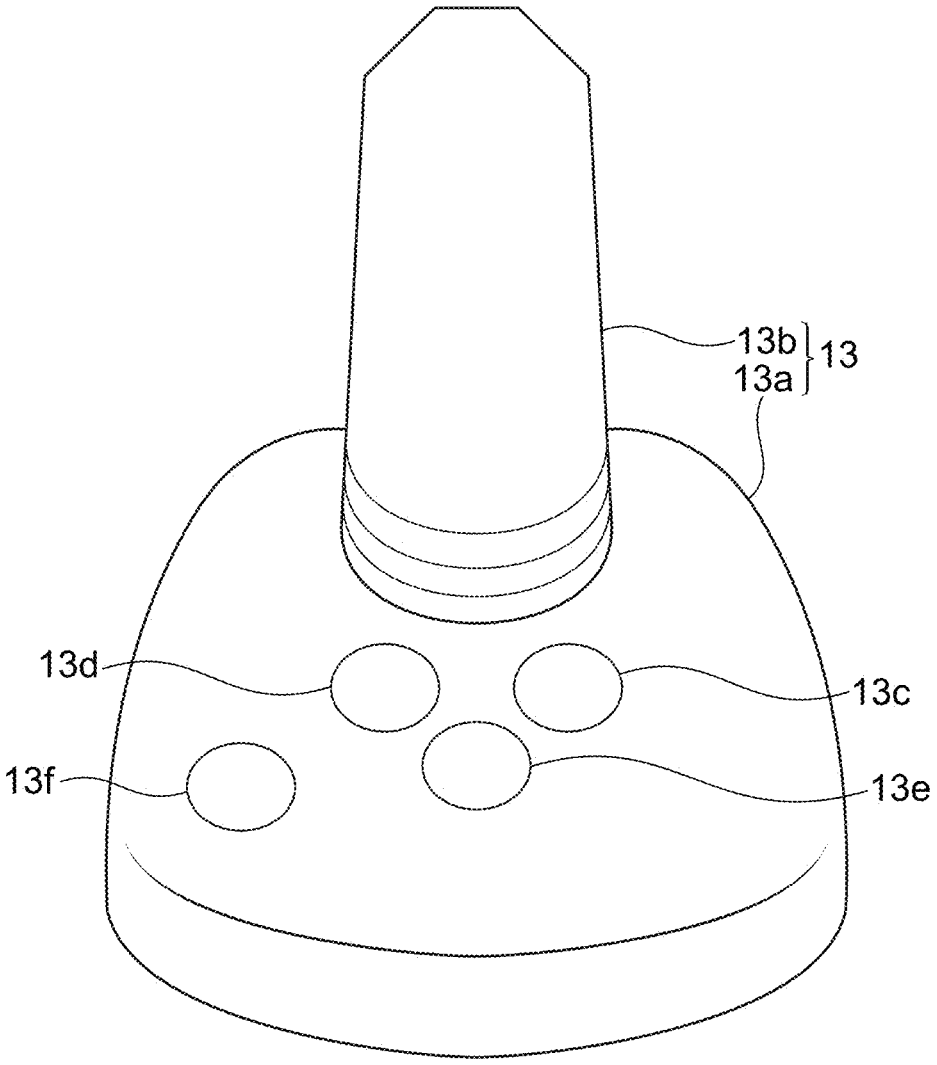
FIG. 4 is a perspective view showing a joystick.

FIG. 4 is a perspective view showing the joystick 13. The joystick 13 includes a main body 13*a* and a columnar stick 13*b* extending upward from the main body 13*a*.

A stay point button 13*c*, a fish point button 13*d*, a drift button 13*e*, and a joystick button 13*f* are arranged on the main body 13*a*. The stay point button 13*c* receives an operation of switching ON and OFF of the Stay Point™. The fish point button 13*d* receives an operation of switching ON and OFF of the Fish Point™. The drift button 13*e* receives an operation of switching ON and OFF of the Drift Point™. The joystick button 13*f* receives an operation of switching ON and OFF of the joystick mode.

The Stay Point™ is one of the automatic maneuvering modes in which the heading of the bow 2B of the hull 2 is maintained at a set target heading and the position of the hull 2 is maintained at a set target point. The Fish Point™ is one of the automatic maneuvering modes in which the hull 2 is directed to a set target point by turning the hull 2 and the moving direction of the hull 2 is maintained toward the target point. The Drift Point™ is one of the automatic maneuvering modes in which the hull 2 is moved by receiving an external force including wind and current while maintaining the heading at the bow 2B of the hull 2 in the target heading by turning the hull 2. It is not essential that all of the above-mentioned buttons are mounted on the main body 13*a*.

Figure 5:
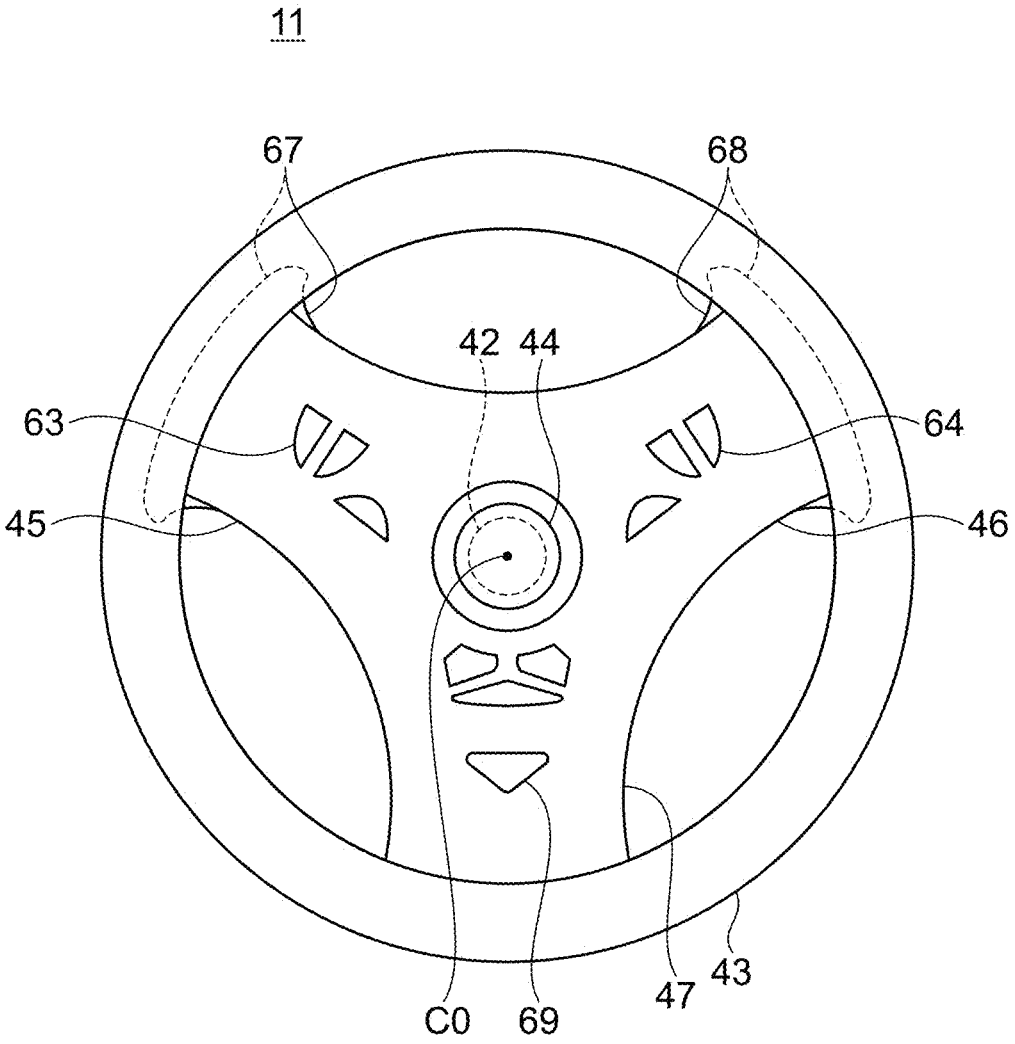
FIG. 5 is a view showing a steering wheel when viewed approximately from a front.

FIG. 5 is a view showing the steering 11 viewed approximately from the front. The steering 11 includes a central portion 44, an annular wheel 43, and three spokes (a first spoke 45, a second spoke 46, and a third spoke 47). The steering 11 is supported by the hull 2 so as to be rotatable about a rotation fulcrum CO.

The steering 11 includes a plurality of switches. For example, a changeover switch 69, a left switch 63, and a right switch 64 are disposed on the surface of the steering 11. The steering 11 includes a left paddle 67 and a right paddle 68. The left paddle 67 and the right paddle 68 are pivotable in the front-back direction. The left paddle 67 and the right paddle 68 are operators to instruct providing the propulsion force to the hull 2 in the backward direction and the forward direction, respectively.

A controller 70 changes the magnitude of the propulsion force in the backward direction according to a throttle opening angle of the left paddle 67 when the left paddle 68 is operated. And the controller 70 changes the magnitude of the propulsion force in the forward direction according to a throttle opening angle of the right paddle 68 when the right paddle 68 is operated. Mainly in the drive mode, the controller 70 controls the trolling motor 5 and the outboard motor 4 according to the operation signals of the switches 63 and 64 and the paddles 67 and 68.

The joystick mode and the drive mode enable on-the-spot turning in addition to parallel motions including a lateral motion.

The parallel motion means that the hull 2 moves in the horizontal direction without turning in a yaw direction about the center of gravity G (FIG. 1). For example, the lateral motion moves the hull 2 to the left or right without turning. Addition of the propulsion force in the front-back direction during the lateral motion enables the parallel motion of the hull 2 in an oblique direction (obliquely left, right, front, and back). The on-the-spot turning rotates the hull 2 in the yaw direction around the center of gravity G. The parallel motion and the turning may be applied in combination.

About the motions, for example, when the parallel motion is performed in the joystick mode, the hull 2 moves in parallel to a direction in which the stick 13*b* is turned. When the parallel motion is performed in the drive mode, the operations of the left switch 63 and the right switch 64 achieve left lateral motion and right lateral motion of the hull 2, respectively. When the paddles 67 and 68 are operated, the hull 2 moves backward and forward, respectively. When one of the paddles 67 and 68 is operated in parallel with the operation of the left switch 63 or the right switch 64, the hull 2 moves in parallel to an oblique direction because the forward or backward motion is added to the lateral motion.

The stick 13*b* can be operated to twist (or rotate) around the axial center of the stick 13*b*. In the joystick mode, an instruction to turn (or veer) can be given by twisting the stick 13*b*. In the drive mode, an instruction to turn (or veer) can be given by a rotation operation of the wheel 43.

Energizing elements (not shown) are provided about the tilting direction and the twisting direction of the stick 13*b* of the joystick 13, and the stick 13*b* is always biased to a neutral position. Therefore, when the user releases the stick 13*b*, the stick 13*b* automatically returns to the neutral position.

In the present example embodiment, the "plurality of maneuvering modes of using the trolling motor (propulsion device) 5" include a trolling motor single mode in which the marine vessel is maneuvered by using only the trolling motor 5 without using the outboard motor 4, in addition to the cooperation modes, such as the joystick mode, the drive mode, the automatic maneuvering modes, and the normal cooperation mode. However, the maneuvering mode of using the trolling motor 5 is not limited to these modes.

A joystick mode or a drive mode is applicable even in the trolling motor single mode. In this case, the trolling motor 5 is controlled according to the operation of the joystick 13. Alternatively, the trolling motor 5 is controlled according to the rotation operation of the steering 11 and the operation of the throttle operator 12.

Figure 6:
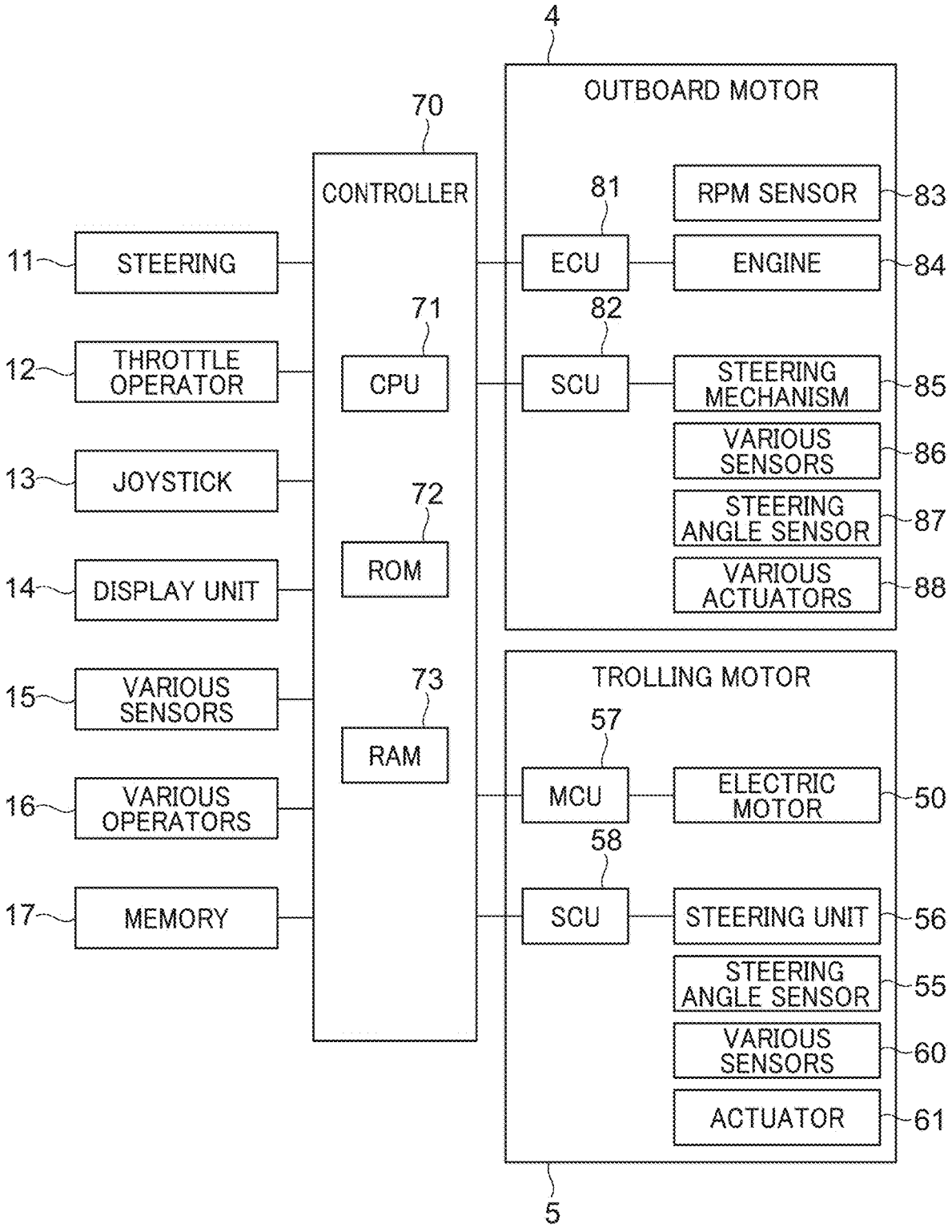
FIG. 6 is a block diagram showing the marine propulsion system.

FIG. 6 is a block diagram showing the marine propulsion system. The marine propulsion system includes a display unit 14, various sensors 15, the various operators 16, and a memory 17 in addition to the controller 70, the outboard motor 4, the trolling motor 5, the steering 11, the throttle operator 12, and the joystick 13.

The controller 70 includes a CPU 71, a ROM 72, a RAM 73, and a timer (not shown). The ROM 72 stores control programs. The CPU 71 achieves various control processes by developing the control programs stored in the ROM 72 onto the RAM 73 and executing the control programs. The RAM 73 provides a work area in executing the control programs by the CPU 71.

The various sensors 15 include a hull speed sensor, a hull acceleration sensor, a heading sensor, a distance sensor, a posture sensor, a position sensor, and a GNSS (Global Navigation Satellite System) sensor. Further, the various sensors 15 include a sensor to detect an operation of the throttle operator 12, a sensor to detect a rotational angular position of the steering 11, a sensor that detects an operation of each switch or paddle in the steering 11, and a sensor to detect an operation of the joystick 13. The hull speed sensor detects a speed (vessel speed) of the navigation of the marine vessel 1 (hull 2). The vessel speed may be obtained from a GNSS signal received by the GNSS sensor. The detection signals of the various sensors 15 are supplied to the controller 70.

The various operators 16 include setting operators to perform various settings and input operators to input various instructions in addition to operators to perform operations related to the maneuvering. Some of the various operators 16 may be arranged on the steering 11. The various operators 16 are operated by the user, and the operation signals are supplied to the controller 70. The memory 17 is preferably a readable and writable nonvolatile storage medium.

The controller 70 may exchange information with the various sensors 15 and the various operators 16 by establishing predetermined communications. The display unit 14 displays various kinds of information.

The outboard motor 4 includes an ECU (Engine Control Unit) 81, an SCU (Steering Control Unit) 82, an rpm sensor 83, an engine 84, a steering mechanism 85, various sensors 86, a steering angle sensor 87, and various actuators 88. Each of the ECU 81 and the SCU 82 includes a CPU (not shown). The ECU 81 controls the driving of the engine 84 according to an instruction from the controller 70. The SCU 82 controls the driving of the steering mechanism 85 according to an instruction from the controller 70.

The steering mechanism 85 changes the direction of the outboard motor body 20 in the left-right direction by rotating the outboard motor body 20 about the steering axis center K (FIG. 1). This changes the direction of the propulsion force acting on the stern 2A, which is the attachment position of the outboard motor body 20. The steering mechanism 85 may be an electric type or a hydraulic type. The various actuators 88 may include a power trim and tilt mechanism (PTT mechanism) that rotates the outboard motor 4 about a tilt axis.

The rpm sensor 83 detects the number of rotations per unit time period of the engine 84. The various sensors 86 include a throttle opening sensor. The steering angle sensor 87 detects an actual steering angle of the outboard motor 4. The controller 70 may obtain the actual steering angle from a steering instruction value output to the steering mechanism 85.

The trolling motor 5 includes an MCU (Motor Control Unit) 57, an SCU (Steering Control Unit) 58, a steering angle sensor 55, various sensors 60, and an actuator 61 in addition to the electric motor 50 and the steering unit 56.

The MCU 57 and the SCU 58 include CPUs (not shown), respectively. The MCU 57 controls the driving of the electric motor 50 according to an instruction from the controller 70. The maximum output of the electric motor 50 may be less than the maximum output of the engine 84 of the outboard motor 4. The SCU 58 controls the driving of the steering unit 56 according to an instruction from the controller 70 to change the direction of the propulsion force acting on the bow 2B, which is the attachment position of the trolling motor 5.

The actuator 61 includes a slide driver (not shown) to slide the rotation shaft 52 in the direction of the rotation axis J (FIG. 2) with respect to the bracket 53. The actuator 61 also includes a pivot driver (not shown) that rotates the bracket 53 relative to the hull 2 about the pivot shaft 59. Thus, the trolling motor 5 can be moved to the use position and the storage position. Moving the trolling motor 5 from the storage position to the use position is referred to as "lowering the trolling motor 5", and moving the trolling motor 5 from the use position to the storage position is referred to as "raising the trolling motor 5". Therefore, the trolling motor 5 can be raised and lowered.

The various sensors 60 include a slide position sensor to detect the slide position of the rotation shaft 52 in the direction of the rotation axis J with respect to the bracket 53. Further, the various sensors 60 include a rotation position sensor to detect the rotation position of the bracket 53 around the pivot shaft 59 with respect to the hull 2. A configuration of each of the sensors is not limited, and a contact type, an optical type, or the like can be used.

The steering angle sensor 55 detects the steering angle of the trolling motor 5 changed by the steering unit 56. The detection signals by the steering angle sensor 55 and the various sensors 60 are supplied to the controller 70. It is not essential that the outboard motor 4 and the trolling motor 5 include all of the above-described sensors and actuators.

Figure 7:
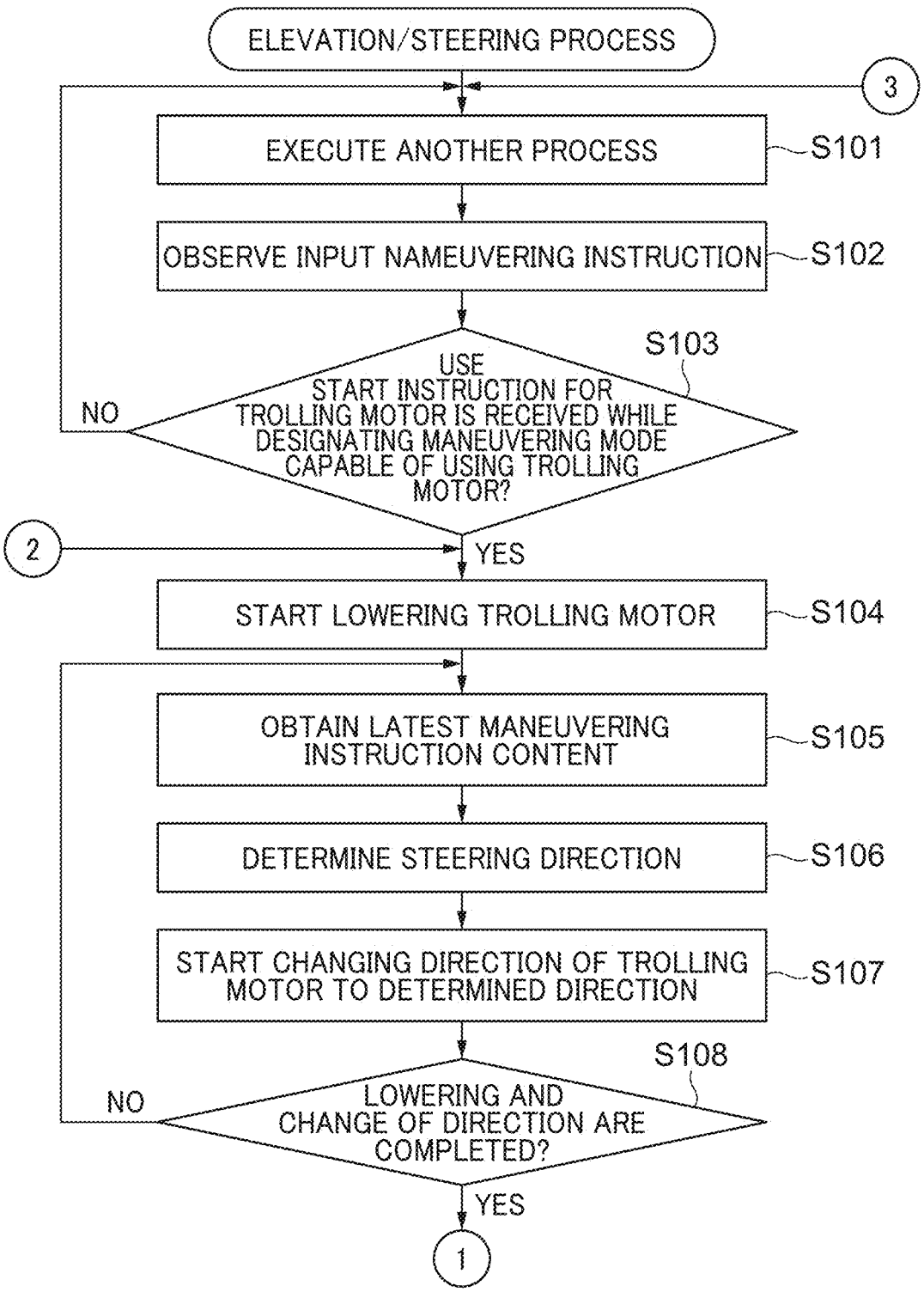
FIG. 7 is a flowchart showing a portion of an elevation/steering process.
Figure 8:
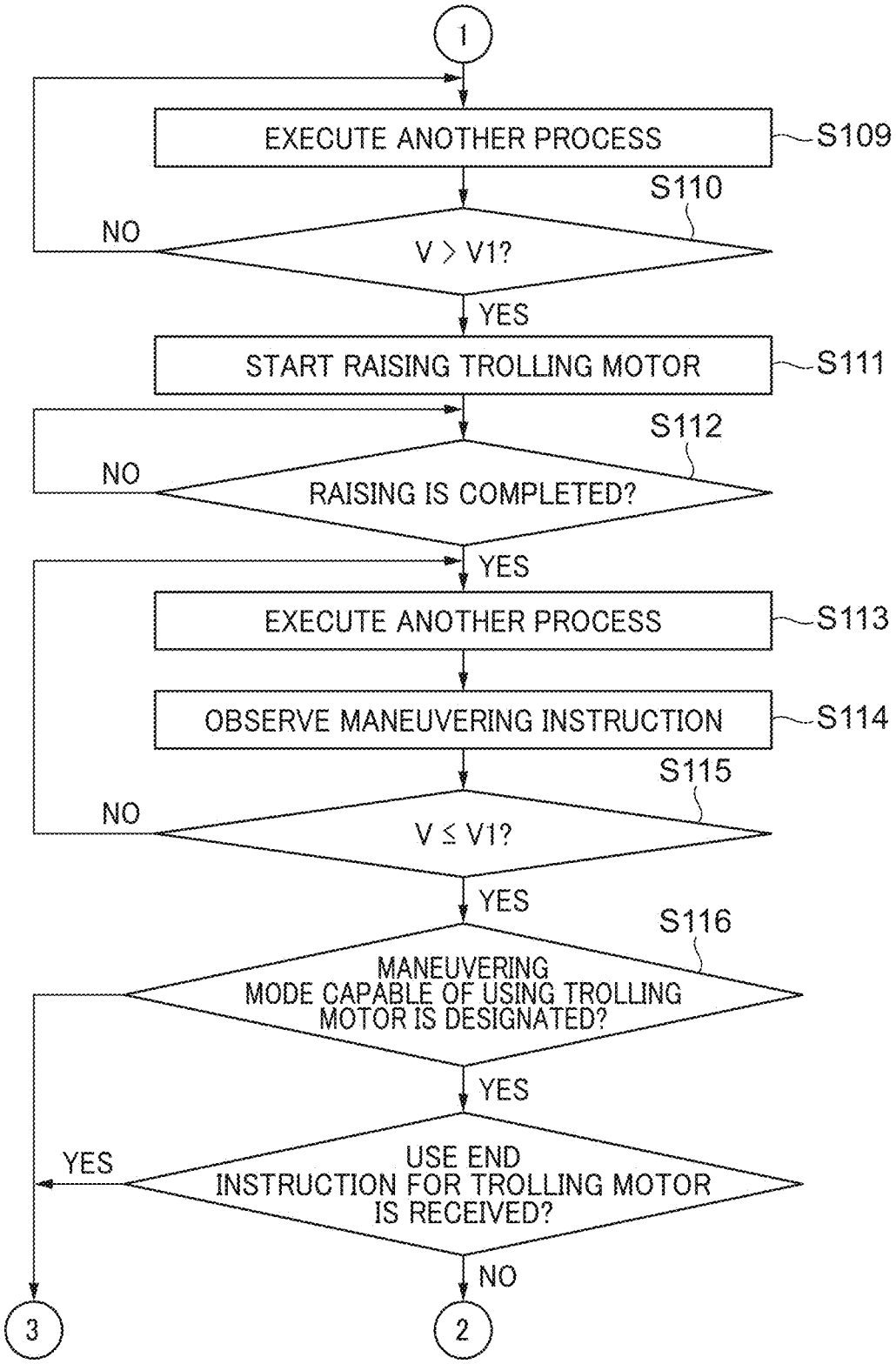
FIG. 8 is a flowchart showing a residual portion of the elevation/steering process.

FIGS. 7 and 8 are flowcharts showing an elevation/steering process. This process is achieved by the CPU 71 developing a program stored in the ROM 72 onto the RAM 73 and executing the program. This process is started when the marine propulsion system is activated, for example. When an instruction to end the process is given during the elevation/steering process, the controller 70 ends the process.

In a step S101, the controller 70 executes another process. Here, a process to receive input of designation/switching of the maneuvering mode, an instruction to end the maneuvering mode, maneuvering instructions about propulsion force, propulsion direction, turning, veering, etc. is executed. The designation of the maneuvering mode is input by, for example, operating a button of the joystick 13, operating the various switches or paddles of the steering 11, or operating the various operators 16. The maneuvering instruction is input by operating the throttle operator 12, the joystick 13, the steering 11, the various operators 16, and a wireless remote controller for the trolling motor 5. The maneuvering instructions in the case where the automatic maneuvering mode is designated include an instruction generated by the determination of the controller 70.

In a step S102, the controller 70 observes an input maneuvering instruction. The controller 70 stores the maneuvering instruction in the RAM 73 and updates the stored contents of the maneuvering instruction in the RAM 73 to the latest contents when a new maneuvering instruction is input.

In a step S103, the controller 70 determines whether a use start instruction for the trolling motor 5 is received while designating the maneuvering mode to be executed among the plurality of maneuvering modes of the trolling motor 5. The use start instruction for the trolling motor 5 is input by operating the various operators 16, the wireless remote controller for the trolling motor 5, etc. Further, when the automatic maneuvering mode is designated, the use start instruction may be input according to the determination of the controller 70. When the use start instruction designating the maneuvering mode of the trolling motor 5 is received, the controller 70 functioning as an element of the receiver proceeds with the process to a step S104. However, if the use start instruction designating the maneuvering mode of the trolling motor 5 is not received, the controller 70 returns the process to the step S101.

In the step S104, the controller 70 controls the actuator 61 to start lowering the trolling motor 5. That is, the controller 70 starts the operation of moving the trolling motor 5 to the use position.

In a step S105, the controller 70 functioning as an element of the obtainer obtains the latest maneuvering instruction content stored in the RAM 73. The timing at which the latest maneuvering instruction is stored may be before or after the start of the lowering of the trolling motor 5. Therefore, if the maneuvering instruction is updated even after the start of the lowering, the updated maneuvering instruction is obtained. At this time point, the updated maneuvering instruction becomes the latest maneuvering instruction.

In a step S106, the controller 70 functioning as an element of the determiner determines the direction (steering direction) of the trolling motor 5 (electric motor 50) on the basis of the maneuvering mode designated in the use start instruction and the latest maneuvering instruction content obtained. As described below, the determined direction of the trolling motor 5 varies depending on the maneuvering mode.

First, when the designated maneuvering mode is the joystick mode, the controller 70 determines the direction of the trolling motor 5 to be the direction corresponding to the latest operation of the joystick 13. For example, the controller 70 determines the direction of the trolling motor 5 in consideration of the steering angle of the outboard motor 4 so that the hull 2 performs a parallel motion to the tilt direction of the stick 13*b*.

When the designated maneuvering mode is the drive mode, the controller 70 determines the direction of the trolling motor 5 to be the direction corresponding to the latest operation of operation instructors on the steering 11. The operation instructors mentioned here include at least the left switch 63, the right switch 64, the left paddle 67, and the right paddle 68. For example, the switches 63 and 64 correspond to first operation instructors to instruct providing a propulsion force in the lateral direction to the hull 2. The paddles 67 and 68 correspond to second operation instructors to instruct providing a propulsion force in the front-back direction to the hull 2.

For example, the controller 70 determines the direction of the trolling motor 5 in consideration of the steering angle of the outboard motor 4 so that the hull 2 performs the parallel motion in the direction determined by the operations of the first operation instructors and the second operation instructors. An operation of an operation instructor other than the switches 63 and 64 and the paddles 67 and 68 on the steering 11, for example, the operation of the wheel 43 may also be involved in the determination of the direction of the trolling motor 5.

When the designated maneuvering mode is the automatic maneuvering mode, the controller 70 determines the direction of the trolling motor 5 to be the direction corresponding to the position and/or heading designated in the automatic maneuvering mode. For example, the controller 70 determines the current states, such as the position, heading, and vessel speed of the hull 2 based on the detection results of the various sensors 15. The controller 70 then comprehensively determines the direction and required propulsion force of each of the outboard motor 4 and the trolling motor 5 that are appropriate to match the current states to the target position and target heading of the hull 2. The controller 70 then determines the direction of the trolling motor 5 according to the result of the determination. In the automatic maneuvering mode, hull information and information about wind, waves, etc. may be used as determinants of the direction of the trolling motor 5.

After determining the direction in this way, in a step S107, the controller 70 controls the steering unit 56 to change the steering angle so that the trolling motor 5 will be directed in the determined direction (to change the direction of the trolling motor 5). The trolling motor 5 may be actually directed in the determined direction before or after the trolling motor 5 reaches the use position.

In a step S108, the controller 70 determines whether the lowering of the trolling motor 5 and the change of the direction of the trolling motor 5 are completed based on the detection signals from the various sensors 60 and the steering angle sensor 55. That is, when it is determined that the rotation shaft 52 has reached the predetermined slide position with respect to the bracket 53 and the bracket 53 has reached the predetermined pivot position with respect to the hull 2 around the pivot shaft 59 based on the detection signals of the various sensors 60, it is determined that the trolling motor 5 has reached the use position (that is, the lowering is completed). When it is determined that the direction of the trolling motor 5 matches the determined direction based on the detection signal of the steering angle sensor 55, it is determined that the change of the direction is completed.

As a result of the determination in the step S108, it is determined that the lowering of the trolling motor 5 is not completed or that the change of the direction is not completed, the controller 70 returns the process to the step S105. Therefore, if the operation instruction is changed until the lowering and the change of the direction are completed, the determined direction may be changed. When the lowering of the trolling motor 5 and the change of the direction are completed, the controller 70 proceeds with the process to a step S109.

In the step S109, the controller 70 executes another process. Here, for example, the maneuvering process corresponding to the maneuvering mode is executed. Alternatively, the switching of the maneuvering mode, the reception of the instruction to end the maneuvering mode, or the like is received and the corresponding process is executed. For example, if the instruction to end the designated maneuvering mode or the instruction to cancel the start of use of the trolling motor 5 (use end instruction), the process of moving the trolling motor 5 to the storage position is executed.

In a step S110, the controller 70 determines whether the vessel speed V detected by the various sensors 15 exceeds a predetermined speed V1 (V>V1?). Then, when the vessel speed V does not exceed the predetermined speed V1, the controller 70 returns the process to the step S109. When the vessel speed V exceeds the predetermined speed V1, the controller 70 proceeds with the process to a step S111.

In the step S111, the controller 70 controls the actuator 61 to start raising the trolling motor 5. That is, the controller 70 forcibly moves the trolling motor 5 in the direction of the storage position to retract the trolling motor 5 from the use position. Thus, even if the designated maneuvering mode is being executed, the trolling motor 5 is extracted from the use position when V exceeds V1. This prevents a high load due to the water flow from being applied to the trolling motor 5.

In a step S112, the controller 70 determines whether the raising of the trolling motor 5 to the storage position is completed based on the detection signals from the various sensors 60. Then, the controller 70 waits until the raising of the trolling motor 5 to the storage position is completed, and when the raising is completed, the controller 70 proceeds with the process to a step S113.

Since it is enough that the trolling motor 5 is removed from the water surface in order to prevent the trolling motor 5 from receiving a high load, the trolling motor 5 is not necessarily moved all the way to the storage position, and may be moved to a position in the middle between the use position and the storage position. The process of retracting the trolling motor 5 when V exceeds V1 is executable during the lowering of the trolling motor 5 (S104 to S108).

In the step S113, the controller 70 executes another process. Here, for example, a process that switches the maneuvering mode or receives the use end instruction for the trolling motor 5, and its corresponding process are executed.

In a step S114, the controller 70 observes the maneuvering instruction in the same manner as in the step S102. In a step S115, the controller 70 determines whether the vessel speed V detected by the various sensors 15 is equal to or less than the predetermined speed V1 (V≤V1). When V exceeds V1, the controller 70 returns the process to the step S113. When V is equal to or less than V1, the controller 70 proceeds with the process to a step S116.

In the step S116, the controller 70 determines whether any one of the maneuvering modes capable of using the trolling motor 5 is designated. When any one of the maneuvering modes is designated, the controller 70 proceeds with the process to a step S117. In the step S117, the controller 70 determines whether the use end instruction for the trolling motor 5 is received.

When any one of the maneuvering modes of the trolling motor 5 is designated (Yes in the step S116) and the use end instruction is not received (No in the step S117), the controller 70 proceeds with the process to the step S104. In this case, the trolling motor 5 is temporarily retracted because the vessel speed V becomes high (V>V1), but the trolling motor 5 automatically returns to the use position because the vessel speed V lowers again (V≤V1). Thus, the user can easily resume using the trolling motor 5 without a burdensome re-operation. At this time, after restarting the use, the change of the direction based on the maneuvering instruction content is executed. Therefore, if the maneuvering instruction is changed after the restart, the direction of the trolling motor 5 is determined and changed again based on the latest maneuvering instruction content.

When any one of the maneuvering modes of the trolling motor 5 is not designated (No in the step S116) or when the use end instruction is received (Yes in the step S117), the controller 70 returns the process to the step S101. In this case, the use start instruction needs to be received again in order to restart using the trolling motor 5.

If the latest maneuvering instruction content is not obtained in the step S106, the controller 70 may determine the direction of the trolling motor 5 to be a predetermined direction (for example, straight).

According to the present example embodiment, the controller 70 starts the process of moving the trolling motor 5 to the use position in response to the reception of the use start instruction designating the maneuvering mode of the trolling motor 5 (S104). Moreover, the controller 70 determines the direction of the trolling motor 5 based on the maneuvering mode designated in the use start instruction and the latest maneuvering instruction content (S106). Then, the controller 70 starts the process of steering the trolling motor 5 to the determined direction before the completion of the movement of the trolling motor 5 to the use position (S107).

This reduces the deviation between the direction of the trolling motor 5 corresponding to the intention of the user or the controller 70 and the actual direction of the trolling motor 5 at the time when the trolling motor 5 is moved to the use position. Therefore, the delay in the start of propulsion by the trolling motor 5 is reduced.

Although the lowering of the trolling motor 5 is started immediately after the reception of the use start instruction, it may be started after the reception of the use start instruction. That is, the direction may be determined and changed while lowering the trolling motor 5. The change of the direction may be started before the completion of the lowering of the trolling motor 5. In the preset example embodiment, the direction change is started immediately after the direction determination, and thereafter, the feedback control of the direction change is continued until the completion of the lowering of the trolling motor 5.

When the joystick mode is designated, the direction of the trolling motor 5 is determined to be the direction corresponding to the latest operation of the joystick 13. When the drive mode is designated, the direction of the trolling motor 5 is determined to be a direction corresponding to the latest operations of the operation instructors on the steering 11. When the automatic maneuvering mode is designated, the direction of the trolling motor 5 is determined to be a direction corresponding to the designated position or the heading (or the target position or the target heading).

Even when the designated maneuvering mode is being executed, if the vessel speed V exceeds the predetermined speed V1, the trolling motor 5 is extracted from the use position, and thus, a high load is prevented from being applied to the trolling motor 5 (S111).

When the vessel speed V becomes equal to or less than the predetermined speed V1 after the trolling motor 5 is extracted from the use position, the trolling motor 5 automatically returns to the use position under the condition that the designated state of the maneuvering mode of the trolling motor 5 continues (S117 to S104). Moreover, after restarting the use, the change of the direction based on the maneuvering instruction content is executed again. These improve convenience.

Although not shown, the marine vessel 1 includes a functional block that achieve the elevation/steering process (FIGS. 7 and 8). The functional block includes functional units, such as the receiver, controller, obtainer, and determiner. The functions of these functional units are implemented mainly by cooperation of the CPU 71, ROM 72, RAM 73, sensors 15, 55, 60, 83, 86, and 87, etc.

Next, a modification will be described. In this modification, the content of the step S103 is changed and the steps S116 and S117 are eliminated in the flowcharts in FIGS. 7 and 8.

Specifically, in the step S103, the controller 70 determines whether a motion start trigger is input instead of determining whether the use start instruction that specifies the maneuvering mode of the trolling motor 5 is received. Designation of the maneuvering mode is not required. The controller 70 detects an instruction or operation to move the trolling motor 5 to the use position as the motion start trigger. For example, when an instruction to lower the trolling motor 5 is input by operating the various operators 16, a foot pedal for the trolling motor 5, a wireless remote controller, or the like, the controller 70 as a detector detects the instruction as the motion start trigger. In addition, the motion start trigger may be input by the determination of the controller 70 in the automatic maneuvering mode.

When it is determined that the motion start trigger is input, the controller 70 executes the process from the step S104. If the determination result in the step S115 is Yes ($V \leq V1$), the controller 70 may return the process to the step S104.

In the application of the example embodiments of present invention, the propulsion device that can be moved between the use position and the storage position and whose direction can be changed by the steering operation is not limited to the trolling motor 5, and may be an auxiliary propulsion device, such as an outboard motor. That is, the propulsion device disposed at a predetermined position in front of the stern 2A is not limited to an electric propulsion device like the trolling motor 5, and may be an engine propulsion device. Further, the propulsion device disposed in the stern 2A is not limited to the outboard motor 4, and may be any one of an inboard motor, an inboard/outboard motor, and a jet boat motor. Further, the propulsion device is not limited to an engine propulsion device and may be an electric propulsion device.

The example embodiments of the present invention can also be achieved by a process in which a program for providing one or more functions of the above-described example embodiments is supplied to a system or an apparatus via a network or a non-transitory storage medium, and one or more processors of a computer of the system or the apparatus that read and execute the program. The program and the storage medium storing the program may correspond to an example embodiment of the present invention. The present invention can also be implemented by a circuit (for example, an ASIC) that implements one or more functions.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion system comprising:

a propulsion device movable between a use position and a storage position and changeable in a direction by a steering operation;

a receiver to receive a use start instruction designating a maneuvering mode to be executed among a plurality of maneuvering modes of the propulsion device;

a controller configured or programmed to move the propulsion device to the use position in response to reception of the use start instruction;

an obtainer to obtain a latest maneuvering instruction content in response to reception of the use start instruction; and a determiner to determine the direction of the propulsion device based on the maneuvering mode designated in the use start instruction and the latest maneuvering instruction content; wherein the controller is configured or programmed to start a process of steering the propulsion device to the determined direction during movement of the propulsion device to the use position and before completion of movement of the propulsion device to the use position in response to reception of the use start instruction; and when a vessel speed exceeds a predetermined speed, the controller is configured or programmed to retract the propulsion device from the use position by forcibly moving the propulsion device in a direction toward the storage position even when the maneuvering mode is being executed.

2. The marine propulsion system according to claim 1, wherein the plurality of maneuvering modes includes a joystick mode in which the controller is configured or programmed to control the propulsion device according to an operation of a joystick; and the determiner is operable to determine the direction of the propulsion device to be a direction corresponding to a latest operation of the joystick when the joystick mode is designated.

3. The marine propulsion system according to claim 1, wherein the plurality of maneuvering modes include a steering wheel maneuvering mode in which the controller is configured or programmed to control the propulsion device based on an operation of a steering wheel including a plurality of operation instructors including at least a first operation instructor to instruct providing a propulsion force in a lateral direction to a hull and a second operation instructor to instruct providing a propulsion force in a front-back direction to the hull; and the determiner is operable to determine the direction of the propulsion device to be a direction corresponding to the latest operation of the plurality of operation instructors when the steering wheel maneuvering mode is designated.

4. The marine propulsion system according to claim 1, wherein the plurality of maneuvering modes include an automatic maneuvering mode to maintain a position of a hull or maintain a heading of the hull; and the determiner is operable to determine the direction of the propulsion device to be a direction corresponding to the position of the hull or the heading of the hull when the automatic maneuvering mode is designated.

5. The marine propulsion system according to claim 1, wherein the plurality of maneuvering modes include an automatic maneuvering mode in which a target position of a hull or a target heading of the hull is designated; and the determiner is operable to determine the direction of the propulsion device to be a direction corresponding to the target position or the target heading when the automatic maneuvering mode is designated.

6. The marine propulsion system according to claim 1, wherein the controller is configured or programmed to move the propulsion device to the use position again after retracting the propulsion device from the use position when the vessel speed is equal to or less than the predetermined speed and any one of the plurality of maneuvering modes is designated.

7. The marine propulsion system according to claim 6, wherein, when the propulsion device is moved back to the use position:

the obtainer is operable to obtain the latest maneuvering instruction content;

the determiner is operable to determine the direction of the propulsion device based on the designated maneuvering mode and the latest maneuvering instruction content; and the controller is configured or programmed to start the process of steering the propulsion device to the determined direction before the completion of the movement of the propulsion device to the use position.

8. The marine propulsion system according to claim 1, wherein the determiner is operable to determine the direction of the propulsion device to be a predetermined direction when the latest maneuvering instruction content is not obtained.

9. The marine propulsion system according to claim 1, wherein the controller is configured or programmed to move the propulsion device to the storage position in response to an instruction to end the designated maneuvering mode.

10. The marine propulsion system according to claim 1, wherein the propulsion device includes a trolling motor.

11. The marine propulsion system according to claim 1, wherein the propulsion device is located at a bow of a hull.

12. A marine propulsion system comprising:

a propulsion device movable between a use position and a storage position and changeable in a direction by a steering operation;

a detector to detect an instruction or an operation to move the propulsion device to the use position as a motion start trigger;

a controller configured or programmed to move the propulsion device to the use position in response to detection of the motion start trigger;

an obtainer to obtain a latest maneuvering instruction content in response to detection of the motion start trigger; and a determiner to determine the direction of the propulsion device based on the latest maneuvering instruction content; wherein the controller is configured or programmed to start a process of steering the propulsion device to the determined direction during movement of the propulsion device to the use position and before completion of the movement of the propulsion device to the use position in response to detection of the motion start trigger; and even when the motion start trigger is detected, the controller is configured or programmed to retract the propulsion device from the use position by forcibly moving the propulsion device in a direction toward the storage position when a vessel speed exceeds a predetermined speed.

13. A marine vessel comprising:

a hull; and a marine propulsion system including:

a propulsion device movable between a use position and a storage position and changeable in a direction by a steering operation;

a receiver to receive a use start instruction designating a maneuvering mode to be executed among a plurality of maneuvering modes of the propulsion device;

a controller configured or programmed to move the propulsion device to the use position in response to reception of the use start instruction;

an obtainer to obtain a latest maneuvering instruction content in response to reception of the use start instruction; and a determiner to determine the direction of the propulsion device based on the maneuvering mode designated in the use start instruction and the latest maneuvering instruction content; wherein the controller is configured or programmed to start a process of steering the propulsion device to the determined direction during movement of the propulsion device to the use position and before completion of the movement of the propulsion device to the use position in response to reception of the use start instruction; and when a vessel speed exceeds a predetermined speed, the controller is configured or programmed to retract the propulsion device from the use position by forcibly moving the propulsion device in a direction toward the storage position even when the maneuvering mode is being executed.

14. A control method for a marine propulsion system including a propulsion device movable between a use position and a storage position and changeable in a direction by a steering operation, the control method comprising:

receiving a use start instruction designating a maneuvering mode to be executed among a plurality of maneuvering modes of the propulsion device;

moving the propulsion device to the use position in response to reception of the use start instruction;

obtaining a latest maneuvering instruction content in response to reception of the use start instruction;

determining the direction of the propulsion device based on the maneuvering mode designated in the use start instruction and the latest maneuvering instruction content;

starting a process of steering the propulsion device to the determined direction during movement of the propulsion device to the use position and before completion of the movement of the propulsion device to the use position in response to reception of the use start instruction; and retracting, when a vessel speed exceeds a predetermined speed, the propulsion device from the use position by forcibly moving the propulsion device in a direction toward the storage position even when the maneuvering mode is being executed.

* * * * *